United States Patent [19]

Whitlock

[11] Patent Number: 4,839,032

[45] Date of Patent: Jun. 13, 1989

[54] SEPARATING CONSTITUENTS OF A MIXTURE OF PARTICLES

[75] Inventor: David R. Whitlock, Burlington, Mass.

[73] Assignee: Advanced Energy Dynamics Inc., Natick, Mass.

[21] Appl. No.: 872,082

[22] Filed: Jun. 6, 1986

[51] Int. Cl.[4] ..... B03C 7/00; B03C 7/08

[52] U.S. Cl. ..... 209/3; 209/11; 209/127.1; 209/129; 210/748; 241/24; 241/79.1

[58] Field of Search ..... 209/127.1–127.4, 209/128–131, 3, 11, 212, 214, 225, 231; 210/748; 241/23, 24, 79.1

[56] References Cited

U.S. PATENT DOCUMENTS

| | | | |
|---|---|---|---|
| 1,100,896 | 9/1914 | Comstock | 209/129 |
| 1,222,305 | 4/1917 | Kraus | 209/127.4 X |
| 1,355,477 | 10/1920 | Howell | 209/127.3 X |
| 2,689,648 | 9/1954 | Maestas | 209/131 |
| 2,847,124 | 8/1958 | Brastad | 209/127.1 |
| 2,889,042 | 6/1959 | Le Baron | 209/127.1 |
| 3,022,889 | 2/1962 | Le Baron et al. | 209/127.1 X |
| 3,140,714 | 7/1964 | Murphy, Jr. et al. | 209/2 UX |
| 3,247,960 | 4/1966 | Brastad | 209/11 |
| 3,449,938 | 6/1969 | Giddings . | |
| 3,493,109 | 2/1970 | Carta et al. | 209/127.1 X |
| 3,635,340 | 1/1972 | Dunn | 209/130 |
| 4,122,002 | 10/1978 | Hauskins, Jr. | 209/127.1 X |
| 4,137,156 | 1/1979 | Morey et al. | 209/212 |
| 4,172,028 | 10/1979 | Dunn | 209/127.1 X |
| 4,302,245 | 11/1981 | Winters | 209/214 X |

FOREIGN PATENT DOCUMENTS

| | | | |
|---|---|---|---|
| 0705007 | 4/1941 | Fed. Rep. of Germany | 209/127.3 |
| 0495088 | 3/1976 | U.S.S.R. | 209/131 |
| 0498042 | 3/1976 | U.S.S.R. | 209/131 |
| 1196033 | 12/1985 | U.S.S.R. | 209/127.1 |

OTHER PUBLICATIONS

SME Mineral Processing Handbook–Norman L. Weiss, Pub. by Society of Mining Engineers of the American Institute of Mining, Metallurgical, and Petroleum Engineers, Inc. 1985, pp. 6–34.

*Primary Examiner*—Johnny D. Cherry
*Assistant Examiner*—Edward M. Wacyra
*Attorney, Agent, or Firm*—Wolf, Greenfield & Sacks

[57] ABSTRACT

The specification describes particle-charging, specie-separating and concentration-enhancing methods and apparatus which operate on a substantially continual basis. The particles of each specie in a mixture are charged by surface contact, separated in an electric field according to their respective polarities by motion in the direction of the field, and the particles of like net polarities are transported in substantially continuous streams, each of opposite net polarity, running near each other, in a direction or directions transverse to the electric field, the streams being in communication parallel to the electric field, so as to transfer particles of at least one of the species to the other of the respective streams by virtue of continued particle contact and field separation of charged particles as the respective streams progress transversely to the electric field. The two streams can run in the same direction (co-current) or in respectively opposite directions (counter-current). The electric field is established between electrodes spaced not more than about 10 mm apart.

45 Claims, 6 Drawing Sheets

SEPARATING CONSTITUENTS OF A MIXTURE OF PARTICLES

BACKGROUND OF THE INVENTION

This invention relates in general to improvements in dry separation processes for the physical separation of different species of the material constituents of a mixture of particles, more particularly to new methods and means for increasing the respective concentrations of separated species of such constituents. The invention is applicable to a wide variety of physical mixtures, such as separating ice crystals from pulverized, frozen, aqueous solutions, as well as to the benefication of ores. It has been found to be particularly useful in the separation of impurities from coal, i.e.: coal benefication.

The constituents of coal which are considered to be "impurities" include those containing sulfur and some minerals which form non-combustible ash. Ash-forming constituents coat, foul and drastically reduce the efficiency of heat transfer in boilers, in addition to polluting the environment. Sulfur-bearing constituents contribute to environmental pollution, one form of such pollution being commonly referred to as "acid rain". As found in its natural state, coal contains varying proportions of these impurities, the proportions in any one deposit depending on the geological history of that deposit.

Coal benefication begins with a process of crushing, pulverizing, or comminuting coal, to break pieces of coal down to particles of smaller and smaller sizes, which frees the constituents from one another and thereby enables them to be separated. Eventually, this process yields particle sizes so small that the cost and difficulty of handling the product becomes formidable barriers to further progress. The finer the coal is comminuted the greater is the portion of the impurity constituents that can be physically freed for eventual separation from the coal. Finely-comminuted coal particles can be confined in a liquid slurry for further treatment, but that approach requires the use of water or other liquid, which adds to the cost and complexity of the separation process and therefore is not economically or logistically desirable on a commercial scale. Dry-separation processes involve the steps of electrically charging the particles in a mixture and thereafter separating charged particles in an electric field in a gaseous medium. However, the dry-separation processes that are now available to commerce and industry do not deal efficiently with the finer-sized constituents of particulate mixtures (e.g.: smaller than 37 microns, or 400 mesh).

It is customary in the known processes to first impart electric charges to the different species of constituents, and then to separate the species in an electric field on the basis of different polarities, but the efficiency of this second step depends on the particles retaining their respective charges until they come under the influence of the electric field. The present invention introduces a new dry-separation process which overcomes these deficiencies in a new way.

Similar problems are encountered in the beneficiation of phosphate ores, which are mined in a matrix comprised of pieces of phosphate rock and silica admixed in a clay-like material known as "slimes." The matrix material must be disintegrated as much as possible in order to efficiently recover phosphate rock. In the process, significant quantities of ultra-fine particles (slimes) are produced.

In the preparation of concentrates of foods and other substances from liquid solution and slurries it would be useful to concentrate the substances carried in the liquid by freezing the liquid and filtering out particles in its frozen state; for example, to concentrate a fruit juice by freezing and filtering out ice crystals. Present technology removes water by evaporation, which consumes 1000BTU/1b, whereas freezing requires only 144 BTU/1b. The present invention is useful in a freezing process followed by pulverization of the frozen liquid and then removal of the particles of frozen liquid in a dry separation process using electrostatic separation forces.

This invention teaches new methods and means for electrically charging and separating different species of the constituents of coal and other ores, solutions and slurries, including powder-like ultra-fine particles sizes (e.g.: smaller than 100 microns), and for electrically charging a mixture which includes such ultra-fine particles, so as to enable particles of impurities and particles of coal, phosphate, solute or other desired component, or species of constituents of any such mixture, to be separated from each other in an electric field more efficiently than has heretofore been achieved on a commercial scale.

GENERAL NATURE OF THE INVENTION

The present invention employs particle-charging specie-separating and concentration-enhancing methods and apparatus which operate on a substantially continual basis. The particles of each specie in a mixture are charged by surface contact, separated in an electric field according to their respective polarities by motion in the direction of the field, and the particles of like net polarities are transported in substantially continuous streams, each of opposite net polarity, running near each other, in a direction or directions transverse to the electric field, the streams being in communication parallel to the electric field, so as to transfer particles of at least one of said species to the other of said respective streams by virtue of continued particle contact and field separation of charged particles as the respective streams progress transversely to the electric field.

The ultimate compositions of the respective species streams depend on their individual surface contact charging properties. The organic and the inorganic particles in coal develop surface contact charges that are opposite in sign and so a complete separation of organic from inorganic species can in theory be achieved. The individual coal macerals each have slightly different surface contact charging properties and can also be separated from each other. Coal can be separated into several fractions, the inorganic, and several organic streams each with different properties. Thus, coal can be cleaned of extraneous ash and sulfur and then separated into fractions, each with a different level of inherent ash and sulfur.

One common aspect of surface-contact charging of dissimilar materials (e.g.: static cling between different fabrics, rubbing a cat's fur, removing cellophane from a surface) is that in each case large surface areas are first in intimate contact and then separated by a macroscopic distance. The charge transfer occurs during the intimate contact. Then when the dissimilar pieces are physically separated work is done on the charges, increasing their potential, until they can generate strong enough electric fields to produce electrostatic forces (e.g.: static cling) or sparks. The number of charges does not increase, but can decrease due to discharging as the dissimilar materials are separated and positive and negative charges re-combine.

A separation device that uses an applied electric field to separate dissimilar particles with different charges will work best when the magnitudes of the charges are large and the distance for the particles to move are small (i.e.: microscopic rather than macroscopic). On the other hand, in order to process macroscopic amounts of coal or other material, a separator must have a relatively macroscopic volume. The present invention provides a macroscopic volume that has a comparatively microscopic separation dimension by using an apparatus having a large area and a thin thickness, for example, a sheet. Thus, according to the present invention, the rate of separation of charged particles in an electric field is increased by decreasing the time it takes a particle to be separated from an ambient volume of particles. This time can be characterized by the time it takes for a particle to travel from one electrode to the other, which is "distance" divided by "velocity".

The present invention employs an electric field established between two parallel, substantially imperforate, electrodes spaced a distance "T" apart, which in practice is preferably less than about 10 mm, defining a path of thickness T through which to drive particulate materials in one or more streams running transversely to the field so as to electrically charge particles of the materials by physical contact while running in the stream or streams. A mixture of particles of different species of materials is driven by mechanical means in the stream or streams while simultaneously the field separates the species one from another in accordance with their respective charges, by inducing particle motions parallel to the field, thereby enriching the concentration of one of the species in each of the stream or streams. In accordance with the invention the thickness T of the field is minimized, less than 10 mm. being found to be about optimum considering the space requirement of a moving stream or streams of particles and for mechanical means to establish and maintain such stream or streams. The maximum field strength is limited substantially only by the spark breakdown characteristics of the ambient gas (if any) between the electrodes.

Particles of the different species of materials resident between the electrodes upon being contact-charged exhibit space charges in the field which oppose the field. "Space charge" is the sum of charges (Coulombs per particle) on all the particles per a unit area of electrode in the space between the electrodes. The effect of a unit (Coulomb) of space charge on the field is independent of the separation T between the electrodes; a larger electrode gap has room for a larger mass of particles per unit area of electrode than a smaller gap. The Coulombs of space charge that can be tolerated in the field is independent of T.

Space charge opposes the applied field, creating in effect a series of fields between the plates when particles are present. However, two (or more) gaps having the same applied field, measured in volts per unit of T, have the same maximum level of space charge (i.e.: that level of space charge which is sufficient to cancel the applied field) but, the charge (Coulombs) per particle is higher in a thin gap than in a thicker gap, owing to the smaller number of particles resident at any instant in a unit of space between the electrodes. That is, where the total space charge is the same in each gap, the charge per particle is larger in a thin gap. According to the invention, this larger charge per particle is achieved in part by using a thin gap, which necessitates carrying the particles mechanically through said gap.

The strength of an electric field is the ratio of applied voltage "V" divided by the gap space "T". A small gap T makes possible a small voltage V for the same field strength. However, the spark breakdown field strength is greater for a thinner gap than for a thicker gap. Thus, it is known that the breakdown strength of air is 25 KV/cm for a gap length of about 100 mm., is less for greater-length gaps, and is very much greater for shorter gaps. For a gap of 1.0 mm, the apparent spark-breakdown voltage of air, for plane-parallel electrodes, is about 45 Kv/cm. The present invention makes use of this higher voltage to establish an electric field. This in turn allows an even higher level of space charge to be achieved, and this in turn allows a higher velocity of particles between the electrodes.

The Prior Art

U.S. Pat. No. 4,274,947 discloses a method and apparatus for sorting fluidized particulate material using electrostatic forces. According to the abstract in that patent a multi-constituent mixture of particles is fluidized within a horizontally-elongated container with a gas permeable base, a potential difference is established between a horizontal electrode locate above the bed surface and the base of the bed (a distance of about 100 mm), and opposing horizontal motions are induced in the upper and lower strata of the fluidized material by mechanical and gravitational means.

A problem associated with the method shown in U.S. Pat. No. 4,274,947 is that a vertical flow of gas is used to fluidize the particles that are contained in a horizontal bed. This flow of gas causes particles below a certain size to be elutriated from the bed and lost. A further problem is the necessity of using an electrode with a grid like structure to allow for gas to flow, such a grid being very susceptible to detrimental corona formation in spite of the avoidance of sharp corners and edges.

A further disadvantage of this prior art is that the density or weight of particles has a large effect on separation of a mass of particles, and this can lead to undesirable segregation by particles size or weight. A further disadvantage is that the separation achieved at total reflux is only marginally improved by a factor of about $2\frac{1}{2}$ over the separation by density when no electric field is present. This level of improvement occurs when the separation effects due to the electric field and due to density are in the same direction, and are additive. When the separation due to the electric field is opposite that of density differences, the electric field-induced separation is insufficient to counter the gravity-induced separation.

A further problem encountered with the fluidized bed and the fluidizing gas is that the bubbles of gas promote good mixing by displacing solids as they rise vertically, and by entraining solids in the turbulent wake of the bubbles as they rise. This mixing is deleterious to the desired separation because it mixes together particles that have been separated.

A further disadvantage of the method of U.S. Pat. No. 4,274,947 is that the electrode used to establish the electric field becomes coated with charged particulate material to such an extent that turning off the electrostatic field is recommended.

A further disadvantage is the use of a fluidizing gas that must be filtered, compressed, dried and then introduced into the fluidized bed. Then the gas along with the fine particles must be collected and the fine particles removed and either returned to the bed, disposed of, or added un-separated to either the product or the reject, contaminating either one or the other.

A further disadvantage of the fluid bed is its dependence on gravity. It is less suitable under a reduced gravitational field such as the lunar field, because the smaller particles have lower terminal velocities and are more easily elutriated from the bed. It is completely unsuitable for use in a micro gravity environment because as described in the patent the upper horizontal portion of the fluid bed is moved by gravity. Moreover, the fluid bed is horizontal, long and flat, and its orientation can not be changed for more efficient use of available floor area in a building housing the apparatus.

The fluid bed electrostatic separation according to the prior art identified above has its optimum performance at an applied voltage of 17 KV. The electrode gap in that prior art is 100 mm, so this corresponds to an E field of 17/100=0.17 KV/mm. The present invention has its optimum performance at as high a voltage as can be sustained without excessive sparking, or about 5 KV with an electrode gap of 0.090" or 2.3 mm., corresponding to an E field of 2.2 KV/mm, or about 10 times higher than that in the prior art. The higher E field leads to a corresponding increase in the force acting on the particle, and may lead to a 10-fold increase in particle velocity (in the Stoke's Law regime). The decreased gap size leads to approximately a 40-fold reduction in the distance a particle must travel from one electrode to the other.

It has been observed in systems of the present invention that a useful charge value to use for comparing various systems is the space charge value needed to completely neutralize the applied field. This gives a constant value for a given E field. What is more useful is the charge per unit mass, or for identical particles, per particle. This is obtained by dividing the charge for a unit electrode area by the density times the volume within or between the unit electrode areas. This is inversely proportional to the electrode gap. It is demonstrable that, for coal, the space charge per particle is approximately 500 times larger in the present invention than in the fluid bed process of the prior art.

A fluidized bed is most stable with a range of particle sizes. Smaller particles (less than about 20 microns) forms agglomerates or fissures in the bed. A typical density of a fluidized bed of solid particles of pulverized coal is about 30 to 50 lbs/cu ft., and density is an important factor in the use of fluidized beds. In the present invention particles are mixed with the ambient gas by mechanical means for stirring the particles in the separator, and density of the particle mixture is not a factor. Particle motions are substantially independent of gravity. In addition, the use of mechanical conveying means according to the present invention assists in keeping the electrodes clean.

The present invention is not limited to using the bulk density of fluidized coal to achieve separation of different species. The present invention utilizes a mechanical conveying system that will function at any bulk density, not necessarily at the bulk density of a fluidized bed. At a lesser density the charge per unit mass is increased, and the effective viscosity of the fluid is diminished, so as to reduce the force needed to transport a particle through it at a given velocity.

Measurements of bulk density of the coal within a machine according to the present invention is difficult and cannot be done directly because in the use the machine is sealed, and the density can vary continuously, but some material balance calculations have indicated that the density varies continuously from the inlet to the outlet on each side, and for a typical run can be about 13 $lb/ft^3$ at the inlet decreasing to about 1.3 $lb/ft^3$ at the exit. A typical value for a fluid bed is 40 $lb/ft^3$, so by reducing the bulk density by a factor of about 3 to 30 in the present invention a corresponding increase is made in the space charge per particle, and a corresponding decrease in the resistance toward particle motion is simultaneously achieved. An average density reduction factor of 15 is convenient for comparison purposes. It is demonstrable that with this reduction factor the charge per particle can be approximately 8000 times larger with the present invention than with the prior art fluidized bed process. The accumulation of the effects of reduction in distance travelled and larger charge per particles can result in an enormous improvement in the rate of separation. This enormous improvement in the rate of separation can be utilized in several ways in the present invention:

(a) Smaller particles can be separated. It is demonstrable that the characteristic separation time is inversely proportional to the radius of the particle to (e.g.:) the 4th power. Thus the separation of a 10 micron particle can be $10^4$ times more difficult than for a 100 micron particle. The present invention has been used to separate (−) 400 mesh coal (minus 37 microns). There is an effect of particle size and the coarser particles do separate more easily, but with the present invention clay has been removed from pulverized coal demonstrating that effective separation can be achieved even at particle diameters of a few microns.

(b) Separation can be made on difficult-to-separate materials. The enormous decrease in time required for separation to occur allows the use of a much higher velocity to produce the particle circulation. In addition to improved contact between particles at higher impact velocities, faster mechanical separation of particles after impact allows less time for charge to flow back from one particle to another.

The invention provides a separator process and apparatus in which the functions of several parts and steps can exist concomitantly, substantially in a continuum. There is in one embodiment initially a region that is free from external electric fields where particle surfaces can be brought into intimate contact so that dissimilar particles can develop different charges. There is also a region where an external electric field is applied so that particles with charges of opposite sign are forced to move in the direction of the field to different locations. A system to transport the particles transversely to the field from the charging region to the separation region, and then substantially continually to move the separated species of particles to another charging region where the cycle can be repeated over and over again operates so as to increase the respective concentrations of the separated species.

Generally according to the invention, the functions of charging, separating and transporting can exist substantially in the same space. The concentrated product and reject or rejects are moved out of the separator on a continuous basis. Transport of separated species, e.g.:

coal and product and reject, occur with substantially no back mixing. The transport of separated species may be co-current or counter current.

It is one object of this invention to provide a method of separation that does not use gas to fluidize particles to avoid the paticle size limits imposed by particle entrainment, that does not have the complexity and expense of gas handling equipment, and does not have bubbles of gas causing mixing within the separator.

It is another object of this invention to use as strong an electric field as possible, close to break down and without corona, and to allow the apparatus to spark over without damage and the field to quickly recover.

It is another object of this invention to allow operation such that the electric field is at right angles to a gravitational field so that particle weight does not influence separation and more generally it is an object of this invention to allow operation completely independent of any gravitational field.

It is another object of this invention that the electric field electrodes will not become coated with deleterious layers of particles during operation.

It is another object of this invention that the separation be done very quickly and with minimum of hold up within the system.

It is an object of this invention that the separation not be extremely sensitive to the temperature or humidity, or to the material of which the apparatus is constructed.

It is a further object of this invention to allow separation of mixtures of conductive particles as well as mixtures of non-conductive particles with conductive particle and mixtures of non-conductive particles.

It is a further object of this invention to povide a separator that is substantially totally enclosed and operates substantially dust-free.

BRIEF DESCRIPTION OF THE DRAWINGS

In the accompanying drawings

DETAILED DESCRIPTION OF THE DRAWINGS

Figure 1:
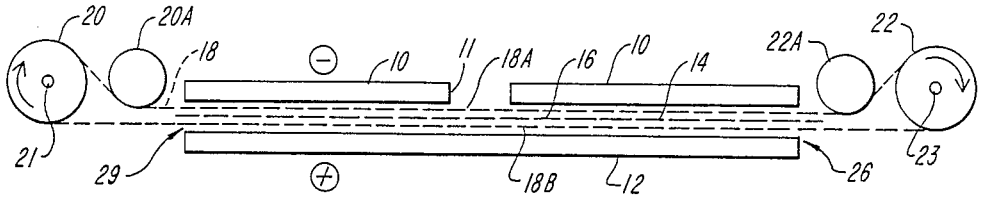
FIG. 1 is a schematic illustration of a particle separating system employing a continuous belt to transport particles in two streams running in opposite directions.
Figure 2:
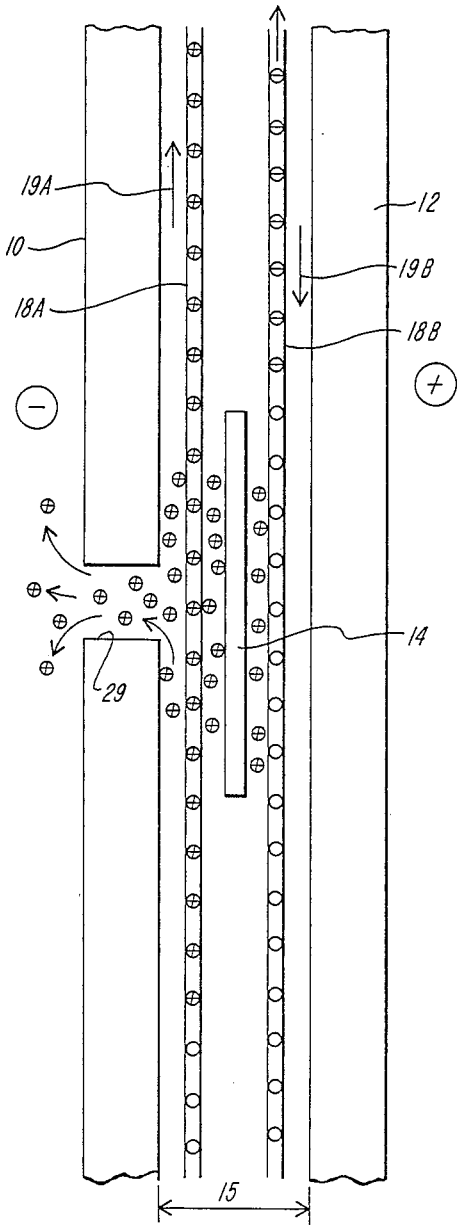
FIG. 2 is an enlarged view of a portion of FIG. 1 showing a "space-charge" process of separation of particle according to their respective charges.
Figure 3:
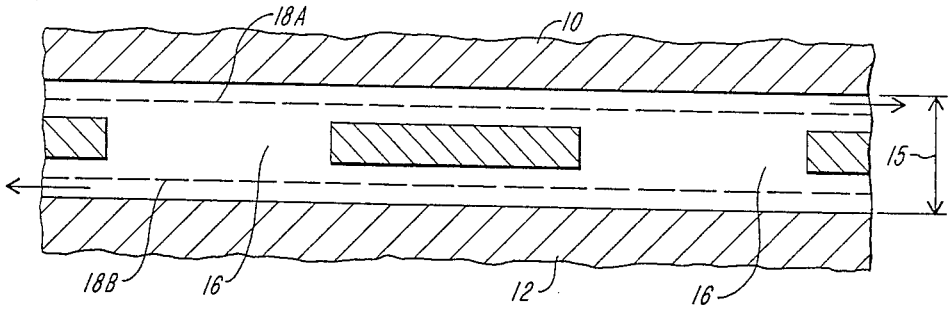
FIG. 3 is an enlarged section of a portion of FIG. 1 showing a means to provide a spatially separated sequence of alternating particle-charging zones and particle-separating elective fields.

In the embodiment of the invention that is illustrated in FIGS. 1–3, inclusive, an electric field is established in a thin gap 15 (about 10 mm) between two extended substantially imperforate electrodes 10 and 12, respectively. A perforated sheet 14 located between the electrodes, made of or coated with a dielectric material, has a series of holes 16 extending between the electrodes. An endless belt 18, preferably an open mesh of dielectric or dielectric-coated screen-like material (represented by dashed lines) is supported on two rollers 20, 22, respectively, one at each end of the apparatus, with respective extended sections 18A and 18B located in the spaces between the intermediate sheet 14 and the respective electrodes 10 and 12. Two tension rollers 20A and 22A, respectively, maintain the extended inter-electrode sections 18A and 18B taught. When the support rollers 20, 22 are rotated, for example, clockwise around their respective axes 21 and 23 as is indicated in FIG. 1, the inter-electrode sections 18A and 18B of the belt move in relatively opposite directions, 18A to the right and 18B to the left, as is indicated by arrows 19A and 19B, respectively, in FIG. 3.

In use, the apparatus of FIGS. 1–3, inclusive, is preferably oriented so that the extended inter-electrode sections 18A and 18B of the endless belt 18 will be in vertical planes. This can be achieved by orienting the support roller axes vertically, side-by-side, with the inter-electrode belt sections 18A and 18B extending horizontally between the rollers or, alternatively, by orienting the support roller axes horizontally, one above the other, with the inter-electrode belt sections extending vertically between them. Either of these preferred arrangement will remove the possibility that gravity will transport the particulate material under treatment between the electrodes, and through the holes 16 in the intermediate sheet 14. The particulate material to be treated (e.g.: pulverized coal) is introduced into the apparatus via a slot-like opening 11 in one of the electrodes 10. Separated products (e.g.: coal and rejects, respectively) are taken out of the apparatus at the ends 26 and 28.

The electric field in the gap 15 will appear between the electrodes 10, 12 where the dielectric of the intermediate sheet 14 is not present, that is, where the holes 16 are located. In the regions where there is a dielectric between the electrodes, charged particles of the particulate material under treatment and ions present within the gap will transport charge from an electrode to the surface of the dielectric confronting that electrode, until the potential at that surface of the dielectric is the same as the potential on the confronting electrode, whereupon electrical driving force to move charged particles in the field no longer exists. The field voltage then appears substantially entirely across the intermediate sheet 14. In this way the perforated, or "holey" intermediate sheet produces a series of alternating regions in the gap 15 which exhibit an electric field interspersed with regions which do not exhibit an electric field. Particle charging occurs in the former, and particle separating occurs in the latter.

Referring in particular to FIG. 2, a hole 29 is provided in one of the electrodes 10 through which charged particles of one species of the particles may be removed from the system. Assuming the electrodes 10, 12 are relative (−) and (+), respectively, the belt section 18A adjacent the first electrode 10 will carry positively-charged particles (product) and the belt section 18B adjacent the second electrode 12 will carry negatively-charged particles (reject). The hole 29 is adjacent an imperforate part of the intermediate sheet 14. Space charge effects due to the (+) and (−) charges on the product and reject, respectively, are substantial and have effects that can be used in this arrangement to augment the effectiveness of particle separation.

The (effectively) dielectric intermediate sheet 14 collects charges (negative confronting the negative electrode 10 and positive confronting the positive electrode 12) until there is no more driving force to transport charge to its surfaces; thus the E-field at the dielectric surfaces of the intermediate sheet 14 must ideally be "0". The local field between each of these surfaces and the respective confronting electrode will then be determined by the space charge and will increase with distance from the dielectric surface. The encircled (+) and (−) signs shown adjacent the respective dielectric surfaces of the sheet 14 represent space charges. If there is a hole in the electrode confronting one of the dielectric surfaces of the intermediate sheet 14 charged particles brouqht adjacent to that hole by a segment of the belt 18A or 18B moving between that surface and the hole will be driven through that hole by the relevant local field. In the illustration of FIG. 2, positively-charged particles are shown leaving through the hole 29 under driving force of the local space charge field between the negatively charged electrode 10 and the confronting (dielectric) surface of the intermediate sheet 14.

This local space-charge field could be increased by using for the intermediate electrode 14, or to coat one or both of its surfaces, a material which contact-charges to one sign or the other. This local space-charge field causes those particles with the highest charge to be removed, through the hole 29, for example. Particles with lesser charges, or particles charged to the opposite polarity from those which the local space-charge field will remove, are not removed, and continue on the belt 18 to be further concentrated and separated.

Holes for removal of separated particles can be provided in both electrodes, adjacent imperforate portions of the intermediate holey sheet 14. However, the electrodes 10, 12 are imperforate where holes 16 through the sheet 14 are between them.

The inter-electrode gap 15 being small, the inter-electrode belt sections 18A and 18B can rub on the confronting surfaces of the electrodes. This rubbing action cleans the electrodes continually, providing a self-cleaning feature of the invention.

Figure 4:
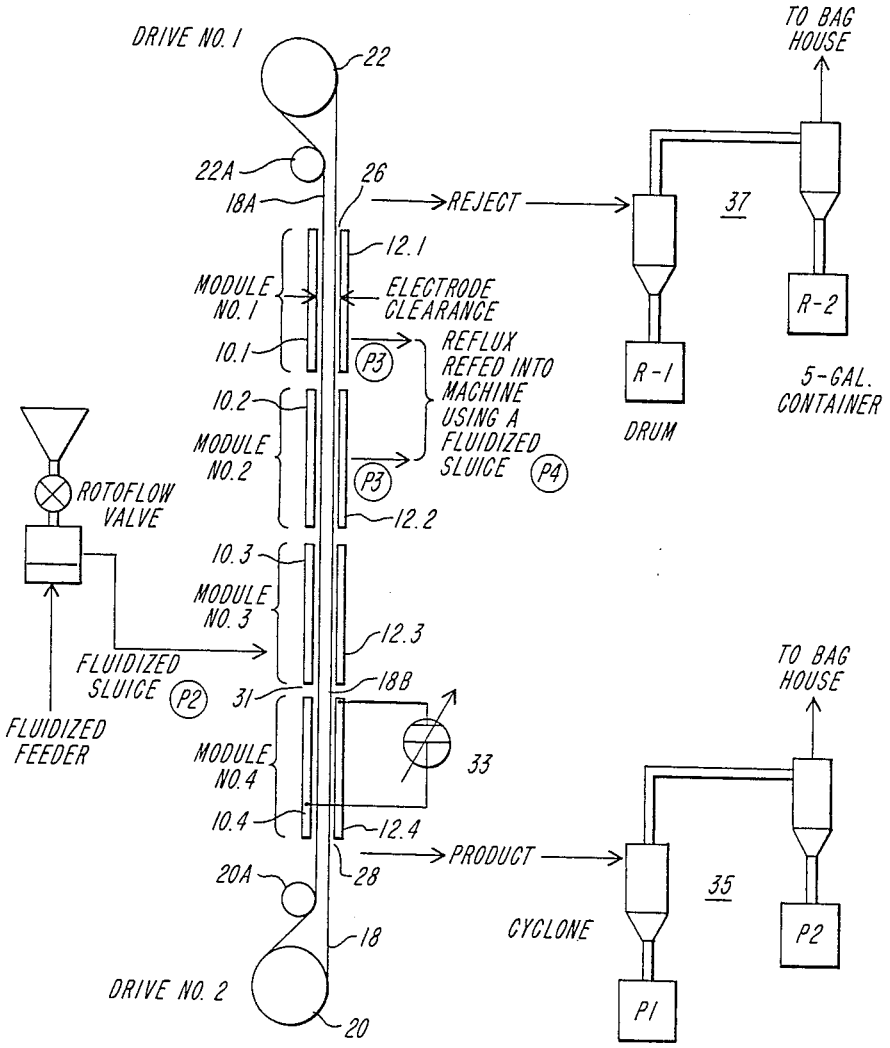
FIG. 4 is a schematic illustration of another continuous belt system.

The embodiment of the invention illustrated in FIG. 4 presents the charging and separating apparatus in a preferred vertical orientation. Also shown are auxiliary components of a complete coal-treating system. The holey sheet 14 is not included in this embodiment of the apparatus, which relies on substantially continuous contact-charging and electrostatic particle separation, in place of the alternate charging and separating steps that are carried out in the embodiment of the apparatus that is illustrated in FIGS. 1–3. Parts of the apparatus that are common to FIGS. 1 and 4 bear the same reference characters.

The electrostatic field is established between several respective sequentially-arrayed modules of plates 10.1, 12.1; 10.2, 12.2; 10.3, 12.3; and 10.4, 12.4 being labelled modules #1, #2, #3 and #4, respectively, on the drawing. The field modules are spaced apart along the apparatus, and a supply of particles to be separated can be introduced in any space between adjacent electrodes, such as in the space 31 between electrodes 10.3 and 10.4. Each module has its own power supply, of which only one 33 is schematically represented connected to the electrodes 10.4 and 12.4 of module #4. Product is taken from the lower end 28 to a cyclone separator station 35 producing product batches P-1 and P-2. Reject is taken from the upper end 26 to a cyclone separator station 37 producing reject batches R-1 and R-2. If desired, reflux of reject may be refed into the apparatus in a space such as the space 39 between electrodes 12.1 and 12.2, between modules #1 and #2. In this embodiment, the oppositely moving belt surfaces 18A and 18B are in close proximity to each other, and they produce a large velocity gradient between the oppositely-polarized field electrodes, which in turn produces a high degree of shear in the ambient gas, which promotes vigorous particle-to-particle contact and enhances particle charging between the electrodes.

The belt 18 is the only moving part in the belt separator apparatus of FIGS. 1 and 4. This belt has several functions common to both embodiments of the apparatus. The first is that of moving particles along the surface of each electrode 10, 12. The second function is that of keeping the electrodes clean by sweeping and scouring the surfaces. In both embodiments the belt must allow particles to transfer from one stream to another under the influence of the electric field, and so must minimally interfere with particle trajectories, which are through the holes 16 when the intervening holey sheet 14 is present. According to the invention, the belt 18 has substantial open area, which may be realized with an openly woven fabric, a foraminous material, an open knit material, or the like. The belt material should not adversely affect the electric field between the electrodes, so a material that is substantially non-conductive, so as not to short out the electrodes, should be chosen. For best performance the belt should be as thin as possible to minimize electrode spacing. To have long life the belt material should be abrasion resistant and have a high strength, should have a low coefficient of friction, be resistant to conditions of temperature and humidity that are present in the machine, and should have a structure which easily allows fabrication of seamless belts.

Figure 6:
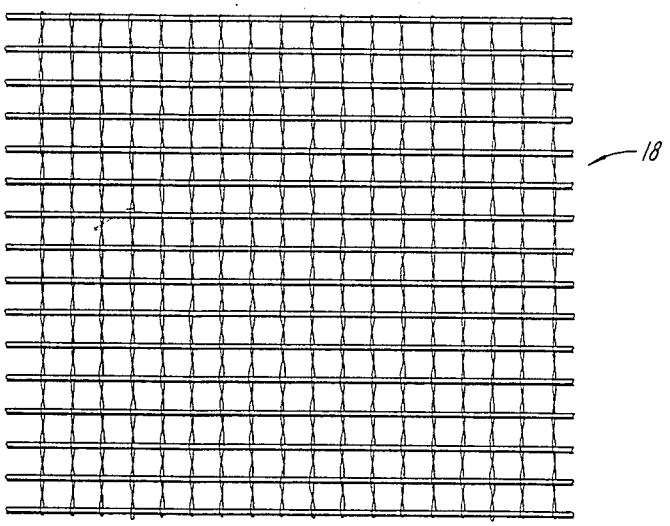
FIG. 6 shows a portion of a mesh belt in full size.

Examples of materials that have been tested and found useful for the purposes of the invention include a 4×4 leno weave made from strands of Kevlar (Trademark) coated with Teflon (Trademark), a swatch of which is shown in FIG. 6, in actual size. This material will withstand high temperatures, is physically strong and is resistant to chemical deterioration. Another material (not illustrated) is a monofiliment polyethylene approximately 7×11 leno weave. This latter material, although not as strong as the "Kevlar/Teflon" material illustrated, is more abrasion resistant, easier to fabricate into belts and is cheaper. An ideal material should have properties found in an ultra-high molecular weight polyethylene fiber which has very high strength, very good abrasion resistance and a low coefficient of friction. The hole sizes and materials mentioned here are illustrative only. It is contemplated that other materials and hole sizes will be useful, and some may yield better separation results than have been achieved up to now. Thus, smaller holes may provide better separation in some instances. The dielectric properties of the belt material will bear a relation to the field strength that can be used, and should be chosen, within the other constraints, to allow high field strengths between the electrodes.

Scaling up belt separator apparatus as shown in FIGS. 1 and 4 can be done by increasing the width of the belt 18. For maximum effectiveness, the belt should be loaded with feed material uniformly over its entire width. A convenient way to do this has been with a fluid bed distributor, schematically shown at 42 in FIG. 4. The function of this distributor is to fluidize pulverized material so that it behaves like a liquid and flows to form a horizontal surface and uniformly overflows a level dam (not shown) to produce a uniform flow of material over the width of the belt. This fluid bed also aerates the feed and breaks up clumps of material so that operation of the separator apparatus is more consistent and uniform. Another function of the fluid bed is to trap high density tramp material such as pieces of metal that may inadvertantly become mixed with the feed.

Figure 5:
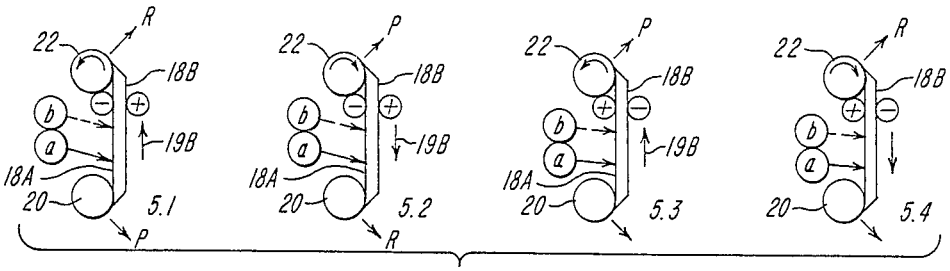
FIG. 5 illustrates a variety of electrical and mechanical configurations in which belt systems according to FIG. 1 or FIG. 4 can be operated.

Belt-separator apparatus according to the invention can be used in any of four electrical and mechanical configurations, which are shown in FIG. 5, at 5.1 to 5.4, respectively. The variation are belt direction and electrode polarity. The capital letters "P" and "R" represent product and reject, respectively. The electrode polarities are indicated by symbols (+) and (−), each encircled. An arrow 19B indicates the direction of belt motion. Two feed locations, (a) and (b), each encircled, are shown in each configuration. In an embodiment according to FIG. 4 which is 16 feet high, consisting of four 30″ long electrode modules, in which the straight sections 18A and 18B of the belt between the electrode are each 10 feet long, feed location (a) is approximately 32 inches above the lower edge of the bottom module #4, and feed location (b) is about 62 inches above the same reference. In a test of this embodiment, using a pulverized coal feed, processed in each of the illustrated four configurations, the following preliminary conclusions were drawn:

1. Best results are obtained when the feed coal does not traverse through the belt (i.e.: the negative electrode is on the feed side);
2. best results are obtained when the reject is transported to the top of the apparatus;
3. feed locations (a) or (b) did not significantly impact the performance of the apparatus.

Configuration 5.1 yielded the best sulfur and ash reductions with nearly the highest fraction of the feed reporting to the product.

These conclusions and results do not necessarily apply to other coals, or to other materials, or to recycling the product or the reject.

Figure 7:
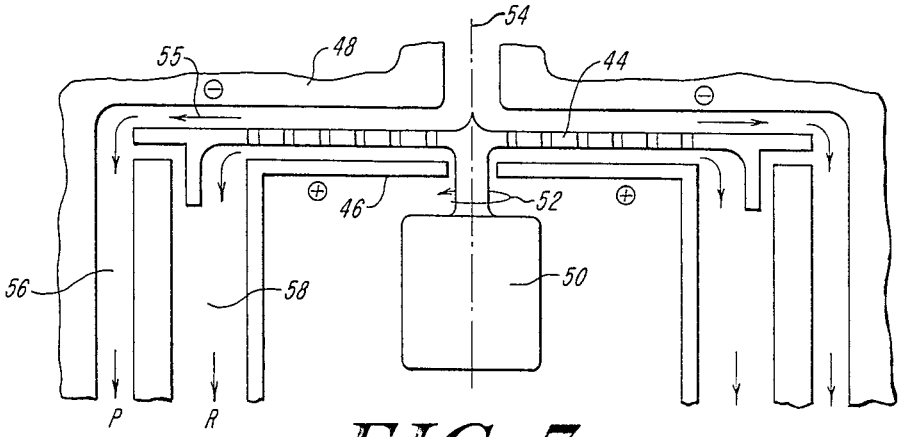
FIG. 7 is an axial section through an illustration of another embodiment of the invention employing a rotating disc.

The apparatus of FIG. 4 performs a continuous countercurrent separation process which separates particles one from another depending on their surface charges. FIG. 7 illustrates another embodiment of the invention which performs a co-current separation process using a rotating holey disk 44 and centrifugal effects to transport the feed material. The disk 44 is located between two electrodes 46, 48 which in use are oppositely polarized, and a motor 50 is used to rotate the disk on a spindle 52. As in FIG. 1, the holey disk 44 is made either of a dielectric material, or has a dielectric coating on its surfaces. The feed material (e.g.: powdered coal) is fed to the apparatus through a hole 54 in one of the electrodes and substantially coaxial with the spindle 52, so that the rotating disk will transport the feed material radially outward between the electrodes. The resulting process is similar to that performed by the apparatus of FIG. 1, but in this case the holey dielectric sheet moves between stationary electrodes, and no other component is needed to transport the feed material between the electrodes. Also, the two streams of charged particles on either side of the holey disk move in the same direction—i.e.: the process is "co-current", indicated by an arrow 55.

In use, feed material is introduced at the center 54 and is picked up by a central impellor (disk 44) where it is thrown out radially. As the feed material moves outward it is accelerated and subjected to a high shear gradient (the disk may have a speed of 100 ft/sec at the circumference and the electrodes are stationary). This shear gradient produces large amounts of turbulence and particle-particle contact that causes contact, e.g.: "triboelectric" charging, at the particle surfaces. The moving holey disk 44 alternately allows the electric field from the electrodes to cause separation and then blocks the field to allow charging. Product (P) and Reject (R), for example, will exit via concentric passage 56, 58, respectively.

The holey disk separator according to FIG. 7 was found to have the characteristic that the stream that passes through the disk is more concentrated than the stream that does not. For example in FIG. 7 the separator is configured so that if coal is fed to the top of the disk the minority material (ash) is collected on the bottom. If the polarity is reversed then the product is much cleaner and is collected on the bottom, but the rejects are much less concentrated. For a complete countercurrent cascade this characteristic can be used advantageously to reduce the number of stages needed for concentrating the rejects in a feed coal in order to get very high BTU recoveries. An example is the 7-stage cascade shown in FIG. 11, employing one feed stage, 3 product recycle stages and 3 reject recycle stages. This configuration will be found to give a very good product. If more reject recycle stages are needed, more product stages and more reject stages can be added. The exact number of stages will be determined experimentally for the particular coal under consideration.

Figure 11:
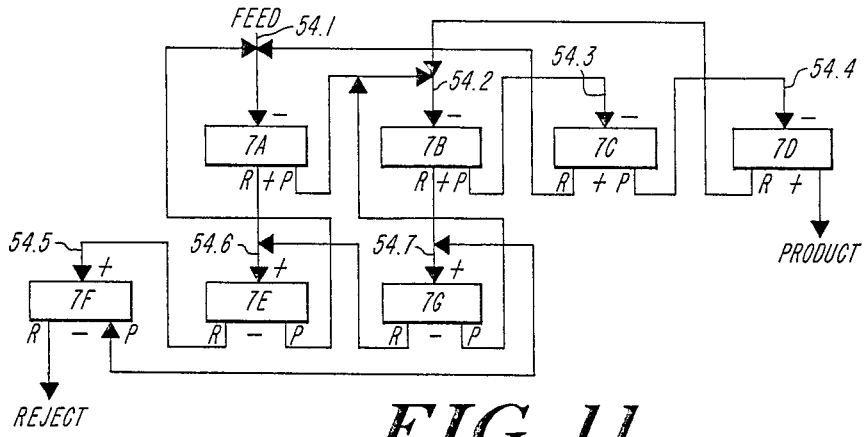
FIG. 11 schematically illustrates a counter-current cascade of separator units according to FIG. 7.

In FIG. 11, separator machines 7A, 7B, 7C and 7D with negative polarity on the feed side 54.1; 54.2; 54.3; 54.4; respectively, produce a reject that is quite concentrated. These machines are used on the product side of the cascade to strip out high ash material from the product. In this configuration the product stays on the same side of the holey disk as the feed, and is collected in the outermost concentric passage (56 in FIG. 7). The reject is collected in the inner passage (58 in FIG. 7). Machines 7E, 7F and 7G with reversed polarity, that is, positive polarity on the feed side, are used on the reject side of the cascade, and are used to strip out coal from the high ash stream. With positive polarity on the feed side the reject material is collected in the outermost passage (56 in FIG. 7) and the product is collected in the innermost passage (58 in FIG. 7).

The various products and rejects from the various machines are reprocessed to obtain additional separation of ash minerals from coal. Streams are either fed to a new machine, or combined with a feed stream that is similar in composition. In this way separation is not lost by mixing streams of differing composition. It should be noted that the material (either product or reject) that passes through the "holey" disk is sufficiently enriched that it is advantageous to skip an intermediate machine when transporting material toward the product or reject side of the cascade. With this arrangement individual separators that are co-current can be arranged in a counter-current cascade.

Figure 8:
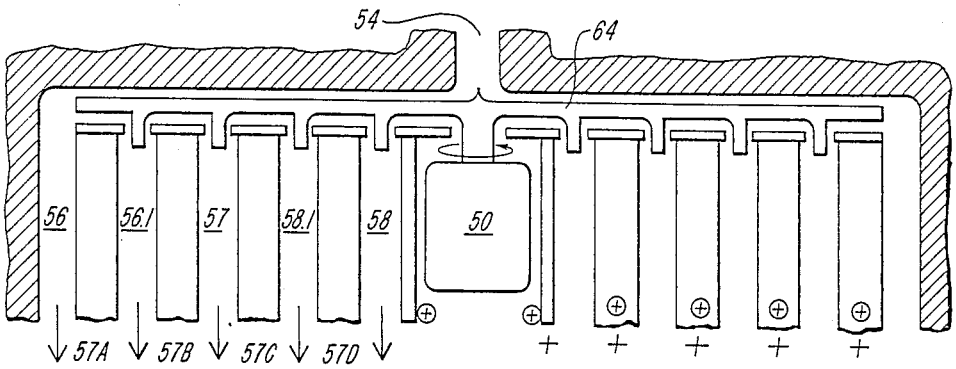
FIG. 8 is an axial section through an illustration of a multi-stage separator developed from the embodiment of FIG. 7.
Figure 12:
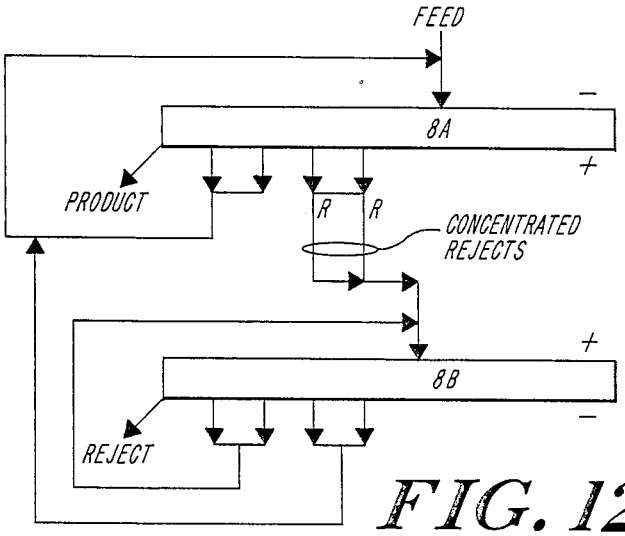
FIG. 12 schematically illustrates an arrangement of two multi-stage machines according to FIG. 8 connected together in a system, and FIG. 13. is a schematic illustration of another continuous belt system according to the invention.

FIG. 8 shows a multi-stage version of the holey disk separator developed from the embodiment of FIG. 7. A holey disk 64 cooperates with a concentric group of annular electrodes 57A, 57B, 57C, 57D to feed an inner collection passage 58, an outer collection passage 56, and intermediate collection passages 56.1, 57 and 58.1. In this configuration the outermost collection passage 56 collects product, and the progressively-inner collection passages 56.1; 57 and 58.1 collect reject with the concentration of ash being progressively higher toward the center passage 58. FIG. 12 shows an arrangement of two such machines 8A and 8B connected together to give a very clean product and a very concentrated reject. A further refinement (not illustrated) would be to recycle material to various feed locations located at different distances from the center, so that streams of different composition are not mixed during operation.

Figure 10:
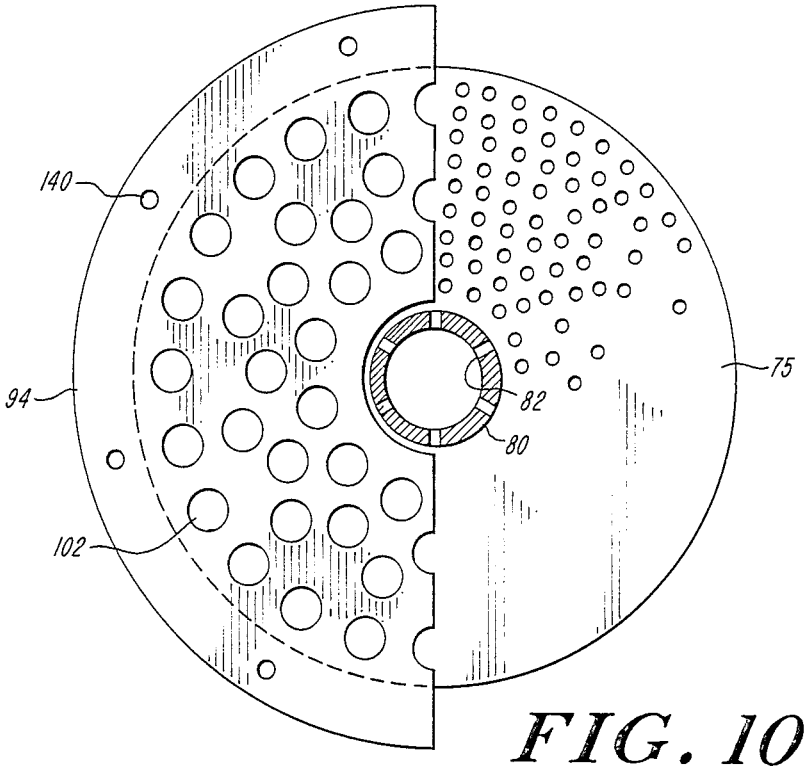
FIG. 10 is section on line 10—10 of FIG. 9.
Figure 9:
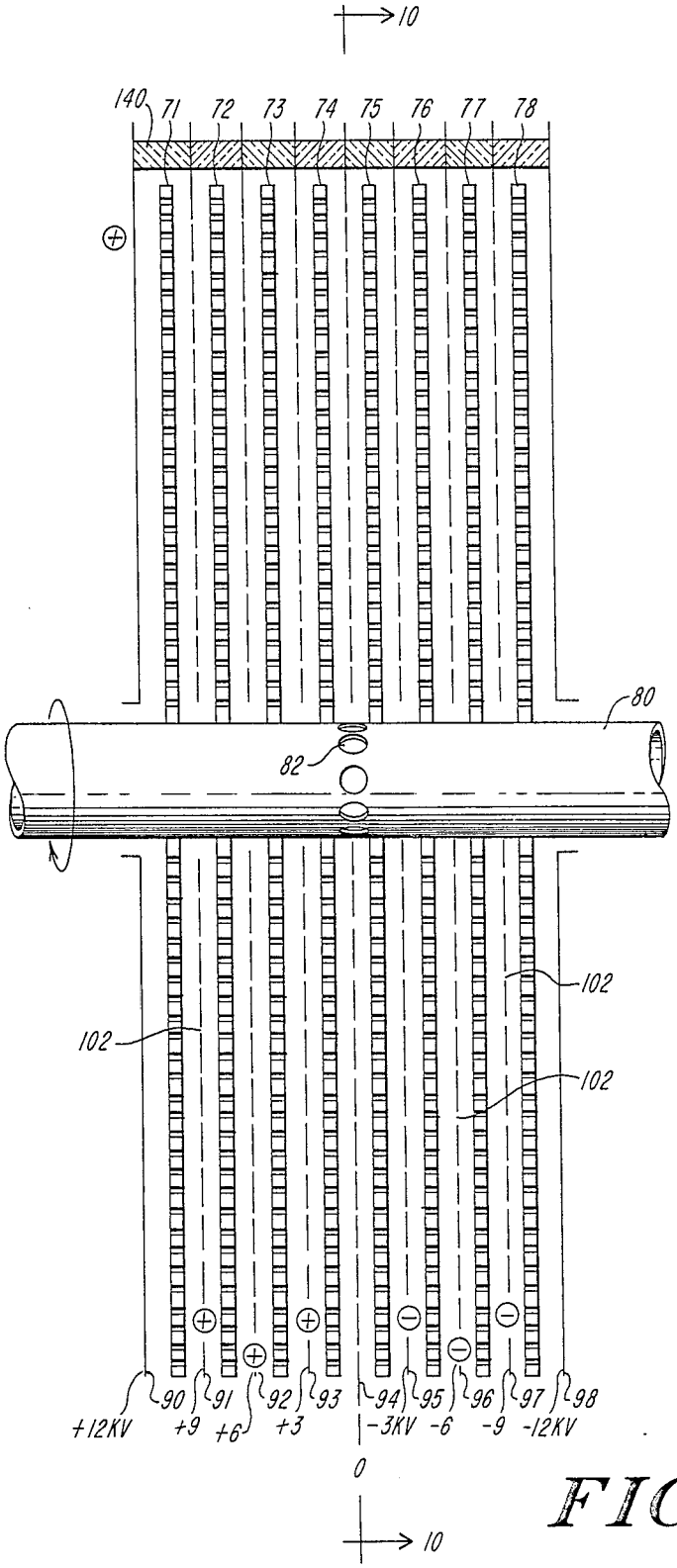
FIG. 9 illustrates another embodiment of the invention.

FIG. 9 shows schematically a multi-stage separator employing a stack of holey dielectric disks 71–78, inclusive, arrayed parallel to each other spaced apart along a central feed tube 80. A circumferential array of feed holes 82 is provided in the tube wall, spaced between the two intermediate adjacent disks 74 and 75. An electrode 91 is located between the first two adjacent disks 71, 72. A second electrode 92 is located between the second two adjacent disks 73, 74, and so forth for electrodes 93–97. End electrodes 90 and 98 are near the outer surfaces of the first holey disk 71 and the last holey disk 78, respectively. The electrodes are spaced from the feed tube 80, being supported separately from it on dielectric spacers 140, as is indicated also in FIG. 10. To provide a series of E-fields across each holey disk, the electrodes may be given progressive potentials, for example, as is indicated in the drawing. Thus, the middle electrode 94 may have "0" potential, electrodes 95–98 to one side of it may have progressively more negative potentials, and electrodes 93–90 to its other side may have progressively more positive potentials. Some of the electrodes between holey disks are fitted with apertures 102 allowing the material being processed to pass back and forth between the positive side and the negative side of the electrode.

In use, the feed tube 80 is rotated, as is indicated by an arrow 81 and particulate feed (e.g.: coal) is fed into it, at one end. Feed coal exits the feed tube via feed holes 82 and is cast radially outward by the disks 71–78 rotating on the feed tube. The electrodes 90–98 are stationary, and are polarized as shown in the figure with the voltage on each electrode being different. The endmost electrode at the reject take off end 90 has the highest voltage. The voltage on successive electrodes is lower, so that there is a substantially constant electric field, both in sign and magnitude, between each pair of adjacent electrodes. This electric field causes charged particles of product and reject to migrate in opposite axial directions.

Figure 13:
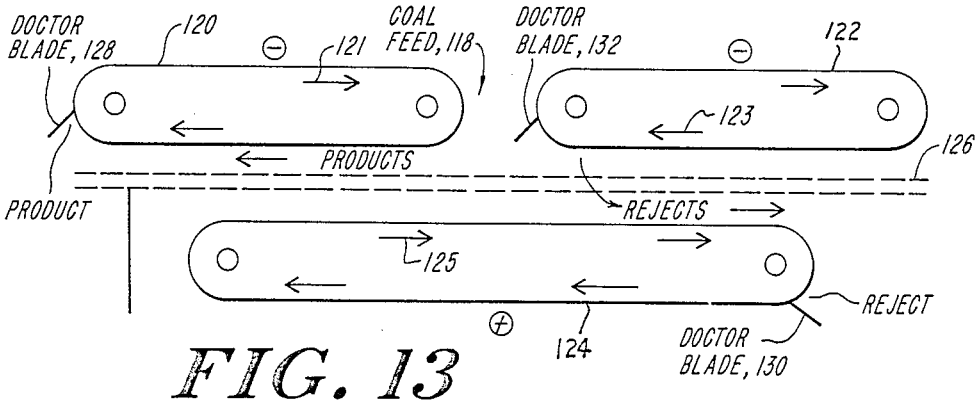

Another configuration is shown in FIG. 13. Belts 120, 122 and 124 made of an electrically conductive material are used both as electrodes, and as the material transport system. The input for feed is at 118, between the two shorter belts 120 and 122. The belts are maintained at a high voltage differential to produce the required field between them, and a dielectric spacer 126 is used to maintain the electrode gap. The belts rotate as indicated by arrow 121, 123 and 125, respectively, and a different belt speed may be used on each belt to enhance separation. Each belt is scraped clean on leaving the separation region, for example, by doctor blades 128 and 130, producing product and reject, respectively. The third belt 122 produces with the aid of doctor blade 132 an intermediate recycle stream that may be mixed with the feed and fed back into the machine.

I claim:

1. Process for separating different species of the material constitutents of a mixture of particles passing through an electric field established between electroles and without requiring gravitational or pneumatic conveyance, said process comprising the steps of:

(a) triboelectrically charging particles of each specie by surface contact, (b) mechanically transporting particles of like net polarities in two streams each of opposite net polarity running near each other between said electrodes both said streams moving transversely to said electric field, and (c) electrostatically separating charged particles of each specie in the electric field established between electrodes spaced not more than about 10 mm apart, substantially exclusively according to their respective polarities, by motion of charged particles in the direction of said field, said streams being in communication parallel to said electric field, so as to transfer particles of at least one of said species to the other of said respective streams by virtue of continued particle contact and field separation of charged particles as said streams progress transversely to said electric field.

2. Process for separating different species of the material constituents of a mixture of particles passing through an electric field established between electrodes and without requiring gravitational or pneumatic conveyance, said process comprising the steps of:

(a) charging particle of each specie by surface contact, (b) transporting particles of like net polarities in two strems each of opposite net polarity running near each other between said electrodes transversely to said electric field, (c) separating charged particles of each specie in the electric field established between electrodes spaced not more than about 10 mm apart, substantially exclusively according to their respective polarities, by motion in the direction of said field, and said streams being in communication parallel to said electric field, so as to transfer particles of at least one of said species to the other of said respective streams by virtue of continued particle contact and field separation of charged particles as said streams progress transversely to said electric field, wherein said two streams run in opposite directions.

3. Process for separating different species of the material constituents of a mixture of particles passing through an electric field established between electrodes and without requiring gravitational or pneumatic conveyance, said process comprising the steps of:

(a) charging particles of each specie by surface contact, (b) mechanically transporting particles of like net polarities in two streams each of opposite net polarity running near each other between said electrodes both said streams moving transversely to said electric field, and (c) separating charged particles of each specie in the electric field established between electrodes spaced not more than about 10 mm apart, substantially exclusively according to their respective polarities, by motion of charged particles in the direction of said field, said streams being in communication parallel to said electric field, so as to transfer particles of at least one of said species to the other of said respective streams by virtue of continued particle contact and field separation of charged particles as said streams progress transversely to said electric field, providing a spatially-separated sequence of alternating substantially field-free-particle-charging zones and particles-separating electric fields, and passing said streams sequentially through said zones and fields so as to alternately charge particles of said mixture and separate said species one from the other, for increasing the concentration of at least one of said species as said streams progress through said zones and fields.

4. Process for separating different species of the material constituents of a mixture of particles without requiring gravitional or pneumatic conveyance comprising the steps of:

(a) providing a spatially-separated sequence of a plurality of alternating substantially field-free triboelectric particle-charging zones and a plurality of charged particle-separating electric fields, and (b) mechanically passing a stream of said mixture sequentially through said zones and fields transversely to said electric fields so as to alternately charge particles of said mixture within said particle-charging zone and then separate said species one from the other within said particle-separating electric field and in accordance with the respective charge-receiving potentials of said materials.

5. Process for separating different species of the material constituents of a mixture of particles passing through an electric field established between electrodes and without requiring gravitational or pneumatic conveyance, said process comprising the steps of:

(a) providing an electric field established between two differentially-polarized electrodes spaced not more than about 10mm apart, (b) mechanically passing a stream of said particles transversely to and through said field between said electrodes under conditions creating intense particle-to-particle and particle-to-electrode contacts so as to charge the surfaces of said particles triboelectrically, (c) electrostatically transferring particles from said stream with said field according to their respective electric-charge potentials so as form substantially two streams each of opposite net polarity, said streams running near each other between said electrodes transversely to said electric field, and (d) collecting from said two streams respective groups of particles of each net polarity.

6. Process according to claim 5 as applied to the concentration of a substance from a carrier liquid, including the preliminary steps of preparing said particles from a liquid in which another substance is carried, said preliminary steps comprising freezing the liquid so as to separate particles of said another substance from said liquid in its frozen state, and pulverizing said frozen liquid to provide a mixture of particles of said frozen liquid and said another substance.

7. Process for separating different species of the material constituents of a mixture of particles passing through an electric field establishing between electrodes, said process comprising the steps of:

(a) providing an electric field established between two differentially-polarized electrodes spaced not more than about 10 mm apart, (b) mechanically passing a stream of said particles to and through said field between said electrodes under conditions creating intense particle-to-particle and particle-to-electrode contact so as to charge the surfaces of said particles electrically, (c) transferring particles from said stream with said field according to their respective electric-charge potentials so as form substantially two streams each of opposite net polarity, said streams running near each other between said electrodes transversely to said electric field, and (d) collecting from said two streams respective groups of particles of each net polarity, wherein the direction of the field is substantially horizontal.

8. Process according to claim 7 in which said stream moves in a substantially vertical direction.

9. Apparatus for separating different species of the material constituents of a mixture of particles without requiring gravitational or pneumatic conveyance, said apparatus comprising: a pair of electrodes spaced not more than about 10 mm apart, means to polarize said electrodes differentially so as to establish an electric field between said electrodes, means to introduce said mixture into the space between said electrodes, mechanical means simultaneously to agitate said particles in said space so as to bring about intense collisions between said particles and between some of said particles and said electrodes, whereby to triboelectrically charge and place on surfaces of said particles electrical charges resulting from said collisions, to physically transport said particles in at least one stream running in a path transversely to the direction of said field between said electrodes, and with said field to electrostatically separated by deflecting charged particles from said stream in accordance with the electric charge-receiving potentials of the respective species so as to form substantially two streams each of opposite net polarity running near each other, and means to accumulate particles of each net polarity apart from particles of the other net polarity.

10. Apparatus for separating different species of the material constituents of a mixture of particles comprising: a pair of electrodes spaced not more than about 10 mm apart, means to polarize said electrodes differentially so as to establish an electric field between said electrodes, means to introduce said mixture into the space between said electrodes, mechanical means simultaneously to agitate said particles in said space so as to bring about intense collisions between said particles and between some of said particles and said electrodes, whereby to place on surfaces of said particles electrical charges resulting from said collisions, to physically transport said particles in at least one stream running in a path transversely to the direction of said field between said electrodes, and with said field to deflect charged particles from said stream in accordance with the electric charge-receiving potentials of the respective species so as to form substantially two streams each of opposite net polarity running near each other, and means to accumulate particles of each net polarity apart from particles of the other net polarity, said electrodes extending to define between them an elongated space for said path, said mechanical means including particle agitating means movable between said electrodes in the direction of said path for establishing said stream and for simultaneously agitating said particles as they progress in said path so as to electrically charge the surfaces of said particles substantially continually.

11. Apparatus according to claim 10 wherein said particle-agitating means is an effectively dielectric member extending between said electrodes substantially throughout said elongated space, and including means to move said member thorugh said space substantially parallel to said path.

12. Apparatus for separating different species of the material constituents of a mixture of particles comprising: a pair of electrodes spaced not more than about 10 mm apart, means to polarize said electrodes differentially so as to establish an electric field between said electrodes, means to introduce said mixture into the space between said electrodes, means simultaneously to agitate said particles in said space so as to bring about intense collisions between said particles and between some of said particles and said electrodes, whereby to place on surfaces of said particles electrical charges resulting from said collisions, and to sweep said particles in at least one stream running in a path transversely to the direction of said field between said electrodes, and with said field to defleot charged particles from said stream in accordance with the electric charge-receiving potentials of the respective species so as to form substantially two streams each of opposite net polarity running near each other, and means to accumulate particles of each net polarity apart from particles of the other net polarity wherein said electrodes extend to define between them an elongated space for said path and including particle agitating means movable between said electrodes in the direction of said path for establishing said stream and for simulatneously agitating said particles as they progress in said path so as to electrically charge the surfaces of said particles substantially continually, wherein said particle-agitating means is an effectively dielectric member extending between said electrodes substantially throughout said elongated space, and including means to move said member through said space substantially parallel to said path wherein said agitating means is an endless belt of foraminous material and including roll means adjacent two ends of said elongated space to support two lengths of said belt between said electrodes in said space, and means to turn said rolls so as to move said lengths parallel to each other in respective opposite directions whereby to move said two streams of particles of opposite net polarity in opposite directions through said elongated space.

13. Apparatus according to claim 12 including an effectively dielectric charge-control member located between said two lengths of said belt and extending substantially throughout said elongated space, said charge-control member having a series of apertures through it alternating with un-aperture material in the direction of said path.

14. Apparatus according to claim 13 including a hole through one of said electrodes located opposite an unapertured surface portion of said charge-control member, for expelling through said hole under the driving force of the net local electric field between said surface portion and the portion of said electrode which defines said hole charged particles which are brought into the space between said portions by the length of said foraminous belt which moves between said portions.

15. Apparatus according to claim 12 wherein said electrodes are disposed substantially in vertical planes and said electric field is oriented in a substantially horizontal direction, and said two lengths of foraminous belt are likewise disposed in substantially vertical planes.

16. Apparatus according to claim 15 wherein said two lengths of foraminous belt run in substantially vertical directions.

17. Apparatus according to claim 16 in which said rolls are located in substantially horizontal roll axes, one above and one below said elongated space between said electrodes.

18. Apparatus for separating different species of the material constituents of a mixture of particles comprising: a pair of electrodes spaced not more than about 10 mm apart, means to polarize said electrodes differentially so as to establish an eIectric field between said electrodes, means to introduce said mixture into the space between said electrodes, means simultaneously to agitate said particles in said space so as to bring about intense collisions between said particles and between some of said particles and said electrodes, whereby to place on surfaces of said particles electrical charges resulting from said collisions, and to sweep said particles in at least one stream running in a path transversely to the direction of said field between said electrodes, and with said field to deflect charged particles from said stream in accordance with the electric charge-receiving potentials of the respective species so as to form substantially two streams each of opposite net polarity running near each other, and means to accumulate particles of each net polarity apart from particles of the other net polarity wherein said electrodes extend to define between them a space for said path and including particle agitating means movable between said electrodes for establishing said stream and for simultaneously agitating said particles as they progress in said path so as to electrically charge the surfaces of said particles substantially continually, wherein said particle-agitating means is an effectively dielectric member extending between said electrodes substantially throughout said space, and including means to move said member through said space wherein said electrodes are substantially circular and said agitating means is an effectively dielectric disk located between said electrodes, said disk having apertures through it, a substantially centrally-located aperture through one of said electrodes for supplying said mixture of particles into the space between said electrodes, and means to rotate said disk on an axis that is substantially perpendicular to said electrodes, for mechanically agitating particles of said mixture in the space between said electroddes and simultaneously moving said particles in paths having a radially-outward component of motion.

19. Apparatus for separating different species of the material constituents of a mixture of particles comprising: a pair of electrodes spaced not more than about 10 mm apart, means to polarize said electrodes differnetially so as to establish an electric field between said electrodes, means to introduce said mixture into the space between said electrodes, mechanical means simultaneously to agitate said particles in said space so as to bring about intensse collisions between said particles and between some of said particles and said electrodes, whereby to place on surfaces of said particles electrical charges resulting from said collisions, to physically transport said particles in at least one stream running in a path transversely to the direction of said field between said electrodes, and with said field to deflect charged particles from said stream in accordance with the electric charge-receiving potentials of the respective species so as to form substantially two streams each of opposite net polarity running near each other, and means to accumulate particles of each net polarity apart from particles of the other net polarity, wherein said apparatus is oriented with said electrodes disposed substantially in vertical planes, and said electric field is oriented in a substantially horizontal direction.

20. Apparatus according to claim 19 wherein said stream runs in a substantially vertical direction.

21. Apparatus for separating different species of the material constituents of a mixture of particles comprising: a plurality of electrodes spaced not more than about 10 mm apart, means to polarize said electrodes differentially so as to establish an electric field between said electrodes, means to introduce said mixture into the space between said electrodes, means simultaneously to agitate said particles in said space so as to bring about intense collisions between said particles and between some of said particles and said electrodes, whereby to place on surfaces of said particles electrical charges resulting from said collisions, and to sweep said particles in at least one stream running in a path transversely to the direction of said field between said electrodes, and with said field to deflect charged particles from said stream in accordance with the electric charge-receiving potentials of the respective species so as to form substantially two streams each of opposite net polarity running near each other, and means to accumulate particles of each net polarity apart from particles of the other net polarity wherein said electrodes extend to define between them a space for said path and including particle agitating means movable between said electrodes for establishing said stream and for simultaneously agitating said particles as they progress in said path so as to electrically charge the surfaces of said particles substantially continually, wherein said particle-agitating means is an effectively dielectric member extending between said electrodes substantially throughout said space, and including means to move said member through said space including a hollow tube that is free to rotate on ts longitudinal axis, at least two of said particle-agitating means fixed to the exterior of said tube in axially-spaced relation, an annular array of apertures through the wall of said tube located between said two particle-agitating means, at least three electrode means located one between said two particle-agitating means and one on the opposite side of each of said particle-agitating means, so as to provide at least two inter-electrode spaces each with one of said particle-agitating means in it, means to mount said electrode means separately from said tube, whereby rotation of said tube on its axis will move each of said particle-agitating means through the inter-electrode space between the two electrode means confronting said particle-agitating means, means to introduce said mixture into said tube and via said array of apertures into said inter-electrode spaces, and means to polarize said electrodes with voltages increasing progressively from one outer electrode to the other so as to establish a substantially constant electric field, both in sign and in magnitude, between each pair of successive electrodes.

22. Apparatus according to claim 21 wherein at least some of said electrode means are fitted with apertures through which the particulate material being processed can pass back and forth between both sides of said electrode means.

23. Apparatus for separating different species of the material constituents of a mixture of particles comprising: a pair of electrodes spaced not more than about 10 mm apart, means to polarize said electrodes differentially so as to establish an electric field between said electrodes, means to introduce said mixture into the space between said electrodes, means simultaneously to agitate said particles in said space so as to bring about intense collisions between said particles and between some of said particles and said electrodes, whereby to place on surfaces of said particles electrical charges resulting from said collisions, and to sweep said particles in at least one stream running in a path transversely to the direction of said field between said electrodes, and with said field to deflect charged particles from said stream in accordance with the electric charge-receiving potentials of the respective species so as to form substantially two streams each of opposite net polarity running near each other, and means to accumulate particles of each net polarity apart from particles of the other net polarity, and an effectively dielectric charge-control member located between said two electrodes, and a hole through one of said electrodes confronting said charge-control member.

24. Apparatus for separating different species of the material constituents of a mixture of particles comprising: a pair of electrodes spaced not more than about 10 mm apart, means to polarize said electrodes differentially so as to establish an electric field between said electrodes, means to introduce said mixture into the space between said electrodes, mechanical means simultaneously to agitate said particles in said space so as to bring about intense collisions between said particles and between some of said particles and said electrodes, whereby to place on surfaces of said particles electrical charges resulting from said collisions, to physically transport said particles in at least one stream running in a path transversely to the direction of said field between said electrodes, and with said field to deflect charged particles from said stream in accordance with the electric charge-receiving potentials of the respective species so as to form substantially two streams each of opposite net polarity running near each other, and means to accumulate particles of each net polarity apart from particles of the other net polarity, wherein each of said electrodes is provided by a portion of an endless belt of electrically-conductive material, there being at least two such belts each supported on a pair of rollers on axes relatively fixed to present said portions to form said electrodes, and means to rotate ast least one roller of each belt so that said electrodes are continually replaced.

25. Apparatus according to claim 24 wherein said rotated rolles are rotated at respectively different angular velocities.

26. Apparatus according to claim 24 wherein a first of said electrodes is constituted by a first belt having a first distance between its supporting rollers, and a second of said electrodes is constituted by a second and third belts each having between its support rollers a second distance which is about one-half said first distance, second and third rollers each presenting end-to-end sections of a second electrode portion adjacent said first electrode, a space being provided between said second electrode portions.

27. Apparatus for separating different species of the material constituents of a mixture of particles comprising: a pair of electrodes spaced not more than about 10 mm apart, means to polarize said electrodes differentially so as to establish an electric field between said electrodes, means to introduce said mixture into the space between said electrodes, mechanical means simultaneously to agitate said particles in said space so as to bring about intense collisions between said particles and between some of said particles and said electrodes, whereby to place on surfaces of said particles electrical charges resulting from said collisions, to physically transport said particles in at least one stream running in a path transversely to the direction of said field between said electrodes, and with said field to deflect charged particles from said stream in accordance with the electric charge-receiving potentials of the respective species so as to form subtantially two streams each of opposite net polarity running near each other, and means to accumulate particles of each net polarity apart from particles of the other net polarity, wherein said mechanical means furthermore removes adhering layers of particles from said electrodes.

28. Apparatus according to claim 27 wherein said mechanical means comprises belt means adapted to sweep against said electrodes to provide particle agitation, particle transport and particle removal.

29. Apparatus for separating different species of the material consitutuents of a mixture of particles comprising: a pair of electrodes spaced not more than about 10 mm apart, means to polarize said electrodes differentially so as to establish an electric field between said electrodes, means to introduce said mixture into the space between said electrodes, mechanical means simultaneously to agitate said particles in said space so as to bring about intense colisions between said particles and between some of said particles and said electrodes, whereby to place on surfaces of said particles electrical charges resulting from said collisions, to physically transport said particles in at least one stream running in a path transversely to the direction of said field between said electrodes, and with said field to deflect charged particles from said stream in accordance with the electric charge-receiving potentials of the respective species so as to form substantially two streams each of opposite net polarity running near each other, and means to accumulate particles of each net polarity apart from particles of the other net polarity, wherein said electrodes have defined therebetween a spatially-separated sequence of a plurality of alternating substantially field-free particle-charging zones and a plurality of particle-separating electric fields, said mechanical means passing a stream of said mixture sequentially through said zones and fields transversely to said electric fields so as to alternately charge particles of said mixture within said particle-charging zone and then separate said species one from the other within said particle-separating electric field and in accordance with the respective charge-receiving potentials of said materials.

30. Apparatus according to claim 29 wherein at least one of said electrodes has a hole therein to enable particles to pass therethrough.

31. Process for separating different species of the material constituents of a mixture of particles passing through an electric field established between electrodes, said process comprising the steps of:

(a) providing an electric field established between two differentially-polarized electrodes spaced not more than about 10 mm apart, (b) mechanically passing a stream of said particles transversely to and through said field said electrodes under conditions creating intense particle-to-particle and particle-to-electrode contact so as to charge the surface of said particles electrically, (c) transferring particles from said stream with said field according to their respective electric-charge potentials so as form substantially two streams each of opposite net polarity, said streams running near each other between said electrodes transversely to said electric field, and (d) collecting from said two streams respective groups of particles of each net polarity, wherein the two streams run in opposite directions.

32. Process for separating different species of the material constituents of a mixture of particles passing through an electric field established between electrodes, said process comprising the steps of:

(a) providing an electric field established between two differentially-polarized electrodes spaced not more than about 10 mm apart, (b) mechanically passing a stream of said particles transversely to and through said field between said electrodes under conditions creating intense particle-to-particle and particle-to-electrode contact so as to charge the surfaces of said particles electrically, (c) transferring particles from said stream with said field according to their respective electric-charge potentials so as form substantially two streams each of oposite net polarity, said streams running near each other between said electrodes transversely to said electric field, and (d) collecting from said two streams respective groups of particles of each net polarity, wherein the stpe of passing a stream includes mechanically cleaning the electrodes simultaneously with moving the stream.

33. Apparatus according to claim 32 including providing sequential substantially field-free charging zones and electric fields with the stream passed successively therethrough for providing continued charging and separation.

34. A method of separating different components of a mixture of material in a separation chamber comprising the steps of:

a. admitting said material into the separation chamber, said separation chamber having means defining confronting surfaces spaced more closely than the respective lengths of said confronting surfaces;

b. impressing a separation infunece toward at least one of said confronting surface of said separation chamber;

c. separating said different components in the direction of said separation influence according to their relative influencability to said separation influences;

d. mechanically moving components of like net influencability in streams each of unlike net influencability near each other transversely to said separation influence, said streams being in communication parallel to said separation influence, so as to transfer a portion of at least one of said components to another of said respective streams by virtue of the continued action of said separation influence as said streams progress transversely to said separation influence;

e. removing separated streams from said separation chamber, wherein said streams are mechanically moved in opposite directions.

35. A method as set forth in claim 34 wherein said streams are mechanically moved in opposite directions at different speeds.

36. A method of separating different components of a mixture of material in a separation chamber comprising the steps of:

a. admitting said material into the separation chamber, said separation chamber having means defining confronting surfaces spaced more closely than the respective lengths of said confronting surfaces;

b. impressing a separation influence toward at least one of said confronting surfaces of said separation cahmber;

c. separating said different components in the direction of said separation influence according to their relative influencability to said separation influence;

d. mechanically moving components of like net influencability in streams each of unlike net influencability near each other transversely to said separation influence, said streams being in communication parallel to said separation influence, so as to transfer a portion of at least one of said components to another of said respective streams by virtue of the continued actions of said separation influence as said streams progress transversely to said separation influence;

e. removing separated streams from said separation chamber, wherein said separation influence is impressed in a spatially periodic manner.

37. A method of separating different components of a mixture of material in a separation chamber comprising the steps of:

a. admitting said material into the separation chamber, said separation chamber having means defining confronting surfaces spaced more closely than the respective lengths of said confronting surfaces;

b. impressing a separation influence toward at least one of said confronting surfaces of said separation chamber;

c. separating said different components in the direction of said separation influences according to their relative influencability to said separation influence;

d. mechanically moving components of like net influencability in streams each of unlike net influencability near each other transversely to said separation influence, aid streams being in communication parallel to said separation influence, so as to transfer a portion of at least one of said components to another of said respective streams by virtue of the continued saction of said separation influence as said stream progress transversely to said separation infleunce;

e. removing separated streams from said separation chamber, wherein the step of admitting includes providing more than one feed material admission opening in the separation chamber.

38. A method as set forth in claim 37 wherein feed materials of different composition are each admitted to different regions of the separation chamber at different distances along the direction of motion of said streams.

39. A method of separating different components of a mixture of material in a separation chamber comprising the steps of:

a. admitting said material into the separation chamber, said separation chamber having means defining confronting surfaces spaced more closely than the respective lengths of said confronting surfaces;

b. impressing a separation influence toward at least one of said confronting surfaces of said separation chamber;

c. separating said different components in the direction of said separation influence according to their relative influencability to said separation influence;

d. mechanically moving components of like net infuencability in streams each of unlike net influencability near each other transversely to said separation influence said streams being in communication parallel to said separation inflluence, so as to transfer a portion of at least one of said components to another of said respective streams by virtue of the continued action of said separation influence as said streams progress transversely to said separation influence;

e. removing separated streams from said separation chamber, wherein the step of mechanically moving components includes generating regions of shear within the separation chamber.

40. A method as of separating different components of a mixture of material in a separation chamber comprising the steps of:

a. admitting said material into the separation chamber, said separation chamber having means defining confronting surfaces spaced more closely than the respective lengths of said confronting surfaces;

b. impressing a separation influence toward at least one of said confronting surface of said separation chamber;

c. separating said different components in the direction of said separation influence according to their relative influencability to said separation influence;

d. mechanically moving components of like net influencability in streams each of unlike net influencability near each other transveresly to said separation influence, said streams being in communication parallel to said separation influence, so as to transfer a portion of at least one of said components to another of said respective streams by virtue of the continued action of said separation influence as said streams progress transversely to said separation influence;

e. removing separated streams from said separation cahmber, wherein the step of mechanically moving components includes generating regions with different levels of shear within said separation chamber.

41. Appparatus for separating different components of a mixture of material comprising:

a separation chamber having means defining confronting surfaces spaced more closely than the respective lengths of said confronting surfaces;

means to apply a separation influences across the smaller dimension of the separation chamber toward one of said confronting surfaces;

means to mechanically transport material in streams running transversely to said separation influence, and with said separation inflence deflecting influencable components from said streams in accordance with their influencability; and means to remove separated components from said separation chamber, wherein said mechanical transport means comprises an endless belt of foraminous construction.

42. Apparatus for separating different components of a mixture of material comprising:

a separation chamber having means defining confronting surfaces spaced more closely than the respective lengths of said confronting surfaces;

means to apply a separation influence across, the smaller dimensions of the separation chamber toward one of said confronting surfaces;

means to mechanically transport material in streams running transversely to said separation influence, and with said separation influence deflecting influencable components from said streams in accordance with their influencability; and means to remove separated components from said separation chamber, wherein said mechanical transport means and said confronting surfces are provided by imperforagte endless transport belts.

43. Apparatus for separating different components of a mixture of material comprising:

a separation chamber having means defining confronting surfaces spaced more closely than the respective lengths of said confronting surfaces;

means to apply a separation influence across the smaller dimension of the separation chamber toward one of said confronting surfaces;

means to mechanically transport material to introduce a material mixture into said separation chamber in streams running transversely to said separation influence, and with said separation influence deflecting influencable components from said streams in accordance with their influencability; and means to remove separated components from said separation chamber, wherein more than one means to introduce a material mixture into said separation chamber is provided.

44. Apparatus for separating different components of a mixture of material comprising:

a separation chamber having means defining confronting surfaces spaced more closely than the respective lengths of said confronting surfaces;

means to apply a separation influence across the smaller dimension of the separation chamber toward one of said confronting surfaces;

means to mechanically transport material in streams running transversely to said separation influence, and with said separation infleunce deflecting influencable components from said streams in accordance with their influencability; and means to remove separated components from said separation chamber, wherein a barrier is interposed between said streams.

45. Apparatus as set forth in claim 44 wherein said barrier is permeable to at least one of said different components.

* * * * *